US007240647B2

(12) United States Patent
Betzmeir

(10) Patent No.: US 7,240,647 B2
(45) Date of Patent: Jul. 10, 2007

(54) PISTON ENGINE

(75) Inventor: Helmut Betzmeir, Ottobrunn (DE)

(73) Assignee: Neander Motors AG, Kiel (DE)

( * ) Notice: Subject to any disclaimer, the term of this patent is extended or adjusted under 35 U.S.C. 154(b) by 0 days.

(21) Appl. No.: 11/272,457

(22) Filed: Nov. 10, 2005

(65) Prior Publication Data

US 2007/0079788 A1 Apr. 12, 2007

(30) Foreign Application Priority Data

Oct. 11, 2005 (DE) ..... 10 2005 048 681

(51) Int. Cl.
*F02B 75/24* (2006.01)
*F01M 1/02* (2006.01)

(52) U.S. Cl. ..... 123/53.2; 123/196 R

(58) Field of Classification Search ..... 123/53.2, 123/196 R

See application file for complete search history.

(56) References Cited

U.S. PATENT DOCUMENTS

| | | | | |
|---|---|---|---|---|
| 2,229,788 | A | 1/1941 | Appleton | |
| 4,614,169 | A | 9/1986 | Figliuzzi | |
| 4,690,113 | A * | 9/1987 | Deland | 123/53.2 |
| 4,936,262 | A | 6/1990 | Paul et al. | |
| 5,179,921 | A | 1/1993 | Figliuzzi | |
| 5,339,779 | A | 8/1994 | Zettner | |
| 6,152,098 | A | 11/2000 | Becker et al. | |
| 6,447,268 | B1 | 9/2002 | Abramopaulos | |

FOREIGN PATENT DOCUMENTS

| | | | |
|---|---|---|---|
| DE | 40 13754 | A1 | 10/1991 |
| DE | 100 19 959 | A1 | 10/2001 |
| DE | 103 48 345 | A1 | 3/2005 |
| GB | 450804 | A | 7/1936 |

* cited by examiner

*Primary Examiner*—Noah P. Kamen
(74) *Attorney, Agent, or Firm*—Townsend and Townsend and Crew LLP

(57) ABSTRACT

A piston engine which has at least one dry-running piston-cylinder unit. It has a first housing (1), at least one cylinder arranged in or on the first housing (1) in which a piston is reciprocably arranged. The piston-cylinder unit further has a first crankshaft (4) and a second crankshaft (5), the first and second crankshafts (4, 5) being arranged parallel to each other and synchronously rotating in opposite directions. The axes of rotation (X, X') of the crankshafts (4, 5) are arranged parallel to a center plane (Z) of the cylinder, and they are laterally offset relative thereto. First and second piston rods (6, 7) are pivotally connected to piston (3). The first piston rod (6) has a first end pivotally connected to piston (3) and a second end connected to a crank pin (40) of the first crankshaft (4). The second piston rod (7) has a first end that is pivotally connected to piston (3) and a second end that is pivotally connected to a crank pin (50) of the second crankshaft (5). The crankshafts (4, 5) are journalled in a second housing (8) which holds a lubricant. The crankshafts are arranged so that a respective first end of each crankshaft (4, 5) sealingly projects from second housing (8) to prevent the escape of lubricant into first housing (1). The respective piston rods (6, 7) are arranged in the first housing (1) outside second housing (8).

11 Claims, 2 Drawing Sheets

-20-
-80-
-10-
I
A'
22
31
32
33
36
34
6
3
2
41
40
42
1
12
9
9'
4
45
43
8
46
44
X
84
81
82

-20-
II
A
24
22
30
3
36
34
35
37
31
32
33
2
7
6
41
40
42
46
56
51
50
52
X
X'
4
5

PISTON ENGINE

RELATED APPLICATIONS

This application claims priority pursuant to 35 USC §119 from German patent application No. 10 2005 048681.9 filed Oct. 11, 2005.

BACKGROUND OF THE INVENTION

The invention relates to a piston engine or machine which has at least one dry-running piston-cylinder unit.

Such piston engines are known and are referred to, for example, as so-called crosshead-piston engines or machines. Such machines employ a two-part piston. A first, upper piston section together with the walls of the cylinder define the cylinder volume. A second, lower piston section extends into the lower portion of the cylinder and is spaced apart from the first piston section by a piston bar. This lower portion of the cylinder forms means for lubricating the second piston area. The lower and upper portions of the cylinder are sealed with respect to each other, and the piston bar between the two cylinder sections extends through the seal. In this manner, the upper section of the piston in such a known crosshead-piston engine runs without additional lubricant in the cylinder. The advantage of such a dry-running cylinder is that no lubricant enters the compression space of the cylinder. As a result, when the piston-cylinder unit is used as a compressor, no lubricant becomes entrained in the gas as it is being compressed. When the piston-cylinder unit is used as a pump, no lubricant enters in the fluid that is being pumped. Even when the dry-running piston engine is used as a combustion engine, no lubricant enters the combustion space, which improves the quality of the exhaust gases.

Such a crosshead-piston engine is relatively voluminous and complex due to the two-part piston and the associated, relatively long cylinder required thereby.

SUMMARY OF THE INVENTION

It is therefore an object of the present invention to provide a piston engine with at least one dry-running piston-cylinder unit which is compact in construction and which assures that the piston runs dry in the cylinder even under demanding operating conditions.

A dual crankshafts piston engine according to the present invention employs two crankshafts which rotate synchronously in opposite directions. Each crankshaft is connected to the piston via a piston rod. As a result, the piston is not subject to tipping forces, so that it can be reliably guided inside the cylinder. This eliminates the need of prior art crosshead-piston engines for additional guidance by way of a second piston section in the lower portion of the cylinder. The crankshafts of the piston engine of the present invention are journalled in a separate housing that contains a lubricant, and end portions of the crankshafts sealingly project therefrom. As a result, the crank gear associated with the piston-cylinder unit can be arranged outside the housing that contains the lubricant, thereby eliminating the danger that lubricant enters the compression space of the piston-cylinder unit.

Another aspect of the present invention arranges the synchronization gears inside a second housing that contains the lubricant.

It is further advantageous to construct the second housing integrally with the first housing.

In another preferred embodiment of the present invention, each piston rod is journalled on the corresponding crank pin and relative to the piston in sealed bearings to prevent the escape of lubricants therefrom. Thus, the lubricant needed by the piston rod bearings cannot enter the inner space of the dry first housing and cannot flow past the piston into the compression space.

It is preferred that the crankshafts are journalled inside the second housing on at least one common bearing block. The bearing block is constructed of a material which has a first coefficient of thermal expansion. The synchronization gears are constructed of a material which has a second coefficient of thermal expansion. Further, the bearing block and the synchronization gears in their radial direction are dimensioned, and the first and second coefficients of thermal expansion are coordinated, so that the thermal expansion of the bearing block between the two axes of rotation is substantially the same as the thermal expansion of the synchronization gears.

Journalling the crankshafts in at least one common bearing block means that the forces which act between the crankshafts in a radial direction need not be absorbed via the housing, but instead are absorbed directly by the bearing block. This permits the housing to be constructed of relatively fewer and/or lighter materials and/or dimensions. Further, play between the flanks or opposing surfaces of the teeth of the synchronization gears remains constant and does not change due to temperature changes, particularly in higher performance engines, because the materials of the bearing blocks and the matingly engaged synchronization gears, the dimensions of the bearing blocks and the synchronization gears in their radial direction, the first coefficient of thermal expansion of the material for the bearing blocks, and the second coefficient of thermal expansion for the materials of the synchronization gears are selected and adjusted so that thermal expansion of the bearing block between the two axes of rotation is substantially the same as the thermal expansion of the synchronization gears. This greatly reduces the wear and tear of the tooth surfaces of the gears and notably reduces the noise that is generated by the machine.

In a further preferred embodiment of the present invention, the crankshafts are constructed of a material having a third coefficient of thermal expansion. The bearing blocks, the crankshafts and the gears in their radial direction are dimensioned, and the first, second and third coefficients of thermal expansion are selected and adjusted so that the thermal expansions of the bearing block and the crankshaft sections journalled therein are substantially the same as the thermal expansions of the synchronization gears and the crankshaft sections surrounded by the synchronization gears. In this manner, even the thermal characteristics of the crankshafts are taken into consideration when compensating for the effect thermal expansions have on the play between the mating tooth surfaces.

It is further advantageous in accordance with the present invention to construct the bearing block and the synchronization gears of materials which have the same coefficient of thermal expansion. It is additionally advantageous to construct the crankshafts of a material that has this coefficient of thermal expansion.

It is particularly advantageous to construct the bearing block and the synchronization gears of the same material, and it is further advantageous to construct the crankshafts also of that same material.

In the preferred embodiment of the invention, at least two bearing blocks are provided for journalling the crankshafts.

Another advantageous embodiment of the present invention provides that the other ends of the respective crankshafts project from the second housing and include a crank pin for connection to a second piston-cylinder unit via associated piston rods. Thus, the present invention also provides a double-cylinder piston engine which has two dry-running piston-cylinder units.

Advantageous embodiments of the present invention involve using the piston engine as a compressor, a pump, or a combustion engine. The piston engine can be formed as a multi-stage compressor or a multi-stage pump.

When the piston engine of the present invention has two piston-cylinder units, it is further advantageous to use one of the piston-cylinder units as a dry-running pump or a dry-running compressor, while the other piston engine unit functions as a combustion engine that drives the pump or the compressor.

The piston-cylinder unit functioning as the combustion engine can run either dry or, as is conventional, as a lubricated piston-cylinder unit.

As the foregoing demonstrates, and as is further explained in the description of the preferred embodiments below, the dry-running piston-cylinder unit of the present invention, either using one piston and cylinder or two cooperating piston-cylinder units, can function both as a power generator, such as a combustion engine, or as a power consumer, such as a piston compressor or piston pump. Accordingly, for purposes of the present invention, the term "piston-cylinder unit", and similar terms that may be employed herein, is intended to generically refer to piston-cylinder units which either generate power (e.g. a combustion engine) or consume power (e.g. a pump or a compressor).

In the following the invention is described by way of an example with reference to the drawings.

DESCRIPTION OF THE PREFERRED EMBODIMENTS

Figure 1:
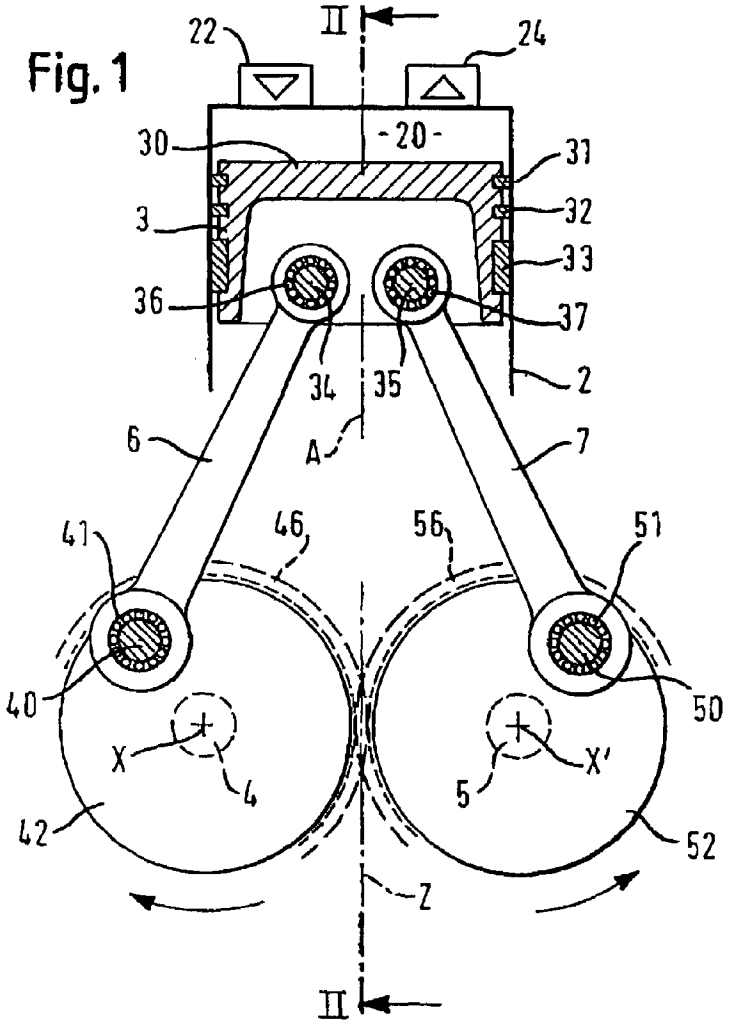
FIG. 1 is a vertical section through a cylinder of a piston engine according to the invention taken along line I-I of FIG. 2.

FIG. 1 schematically illustrates a piston-cylinder unit of a piston engine according to the present invention which includes associated crank gearing. A piston 3 is reciprocably arranged in a cylinder 2 which is coupled to a first housing 1. The walls of the cylinder 2 and the upper surface of piston 30 in cylinder 2 define a cylinder space or a compression space 20. Cylinder 2, which is schematically illustrated in the figures, includes an inlet valve 22 and an outlet valve 24, also schematically shown, which connect the compression space 20 with an intake conduit (not shown) and an exhaust conduit (not shown), respectively.

Spaced-apart piston rings 31, 32 are arranged on the circumference of piston 3 in the vicinity of its end face 30 (spaced apart). Spaced some distance from piston surface 30 and at a lower portion of the piston is a guide ring 33. Guide ring 33 and/or piston rings 31, 32 are made of a material with self-lubricating characteristics such as, for example, PTFE (polytetrafluorethylen) or graphite.

The portion of piston 3 remote from piston surface 30 has two connecting pins 34, 35 which are laterally offset from each other relative to cylinder axis A. Sealed connecting rod bearings 36, 37 are arranged on connecting pins 34, 35, respectively. Each connecting rod bearing 36, 37 at the piston pivotally mounts a piston rod 6, 7 relative to piston 3.

The other ends of piston rods 6, 7 are connected to crank pins 40, 50, respectively, by sealed bearings which prevent the escape of lubricants. The bearings form connecting rod bearings 41, 51 at the crankshaft side of the piston and permit pivotal relative movements. A first crank pin 40 projecting from a crank disk 42 provides connection to a first crankshaft 4. The second crank pin 50 projects from a crank disk 52 which forms a connection to a second crankshaft 5. The first crankshaft 4 and the second crankshaft 5 are parallel to each other and synchronously rotate in opposite directions. The axes X, X' of the two crankshafts 4, 5 are arranged parallel to a common center plane Z of the cylinder, and they are laterally symmetrically offset relative to that center plane Z.

Figure 2:
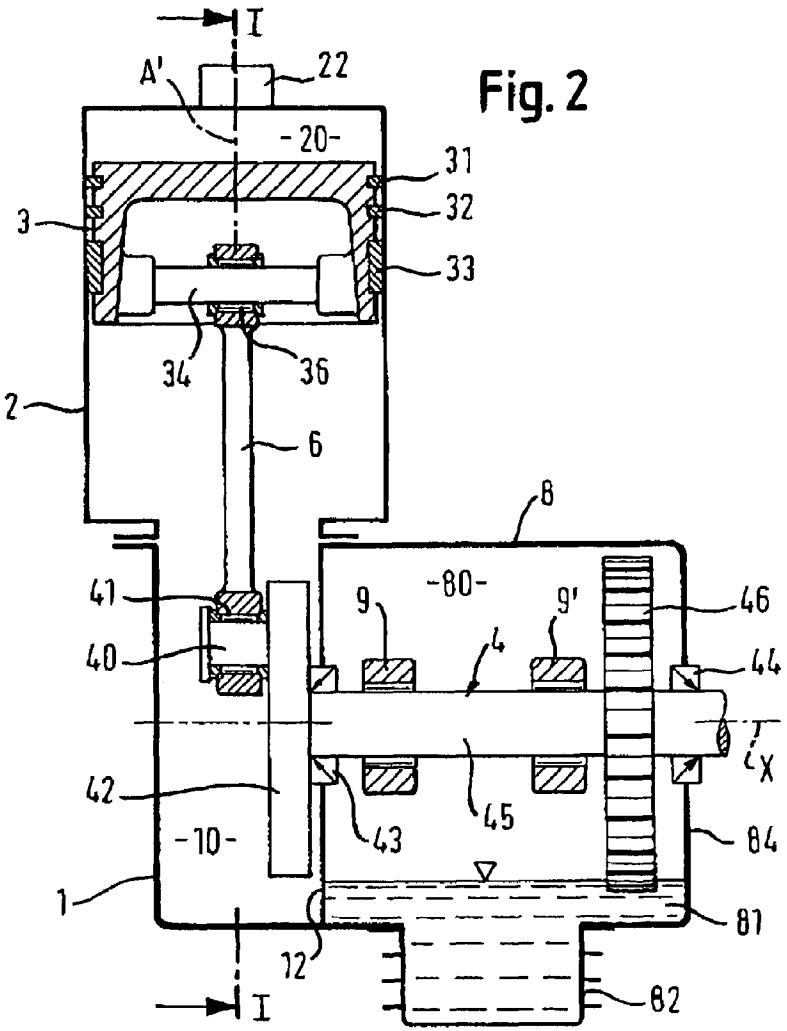
FIG. 2 is a longitudinal cross-section through a piston engine in accordance with the invention taken along line II-II of FIG. 1.

FIG. 2 is a longitudinal section of the piston engine in the direction of arrows II-II in FIG. 2.

A cylinder head defines the upper end of cylinder 2, and the lower end of the cylinder is attached in a conventional manner to a first housing 1 of the piston engine. A crank assembly including crank disks 42, 52 and the piston rods 6, 7 for piston 3 are arranged within first housing 1.

A second housing 8 is formed integrally with the first housing, which is separated from the first housing 1 by a bulkhead 12.

The second housing 8 surrounds a second housing space 80 and includes an oil pan 82 in its lower portion. Oil pan 2 and a lower part of inner housing space 8 are filled with lubricating oil.

Inside second housing 8 are two bearing blocks 9, 9' which journal crankshafts 4, 5 so that each crankshaft 4, 5 is journalled in each of the two bearing blocks 9, 9'. The respective crankshafts 4, 5 arranged inside the second housing 8 are cylindrical and extend from inner space 80 of second housing 8 into the inner space 10 of the first housing via a radial seal arranged in bulkhead 12. FIG. 2 only shows the radial bearing 43 through which crankshaft 4 extends.

The end of at least one of the two crankshafts opposite from bulkhead 12 extends through a radial seal 44 in end wall 84. This projecting end of at least one crankshaft functions as a driven shaft for the piston engine when it operates as a compressor or a pump, and functions as a drive shaft when the piston engine operates as a combustion engine.

The part of each crankshaft 4, 5 inside housing 8 is cylindrical and non-rotatably connected to a synchronization gear 46, 56. Synchronization gears 46, 56 matingly engage each other, and lower portions thereof are immersed in lubricant 81 in the lower part of inner space 80 of housing 8.

By arranging the lubricating crankshaft bearings and synchronization gears 46, 56 inside the second housing 8, liquid lubricant need only be stored in inner space 80 of the second housing. An inner space 10 of first housing 1, which houses the crank assembly, is a lubricant-free dry space. The required journal bearings for the piston rods are sealed bearings which prevent lubricant from escaping so that no lubricant can enter cylinder 2.

The dual crankshaft arrangement of the present invention, together with the two piston rods 6, 7 that are pivotally connected to piston 3, prevent tipping forces from acting on piston 3. As a result, the piston center axis A' is readily guided in the direction of cylinder axis A. Guide ring 33, which is preferably constructed of a self-lubricating material, centers piston 3 in cylinder 2 while piston rings 31, 32 seal the compression space 20 with respect to the lower part of cylinder 2, which is in communication with the inner space of housing 1.

Figure 3:
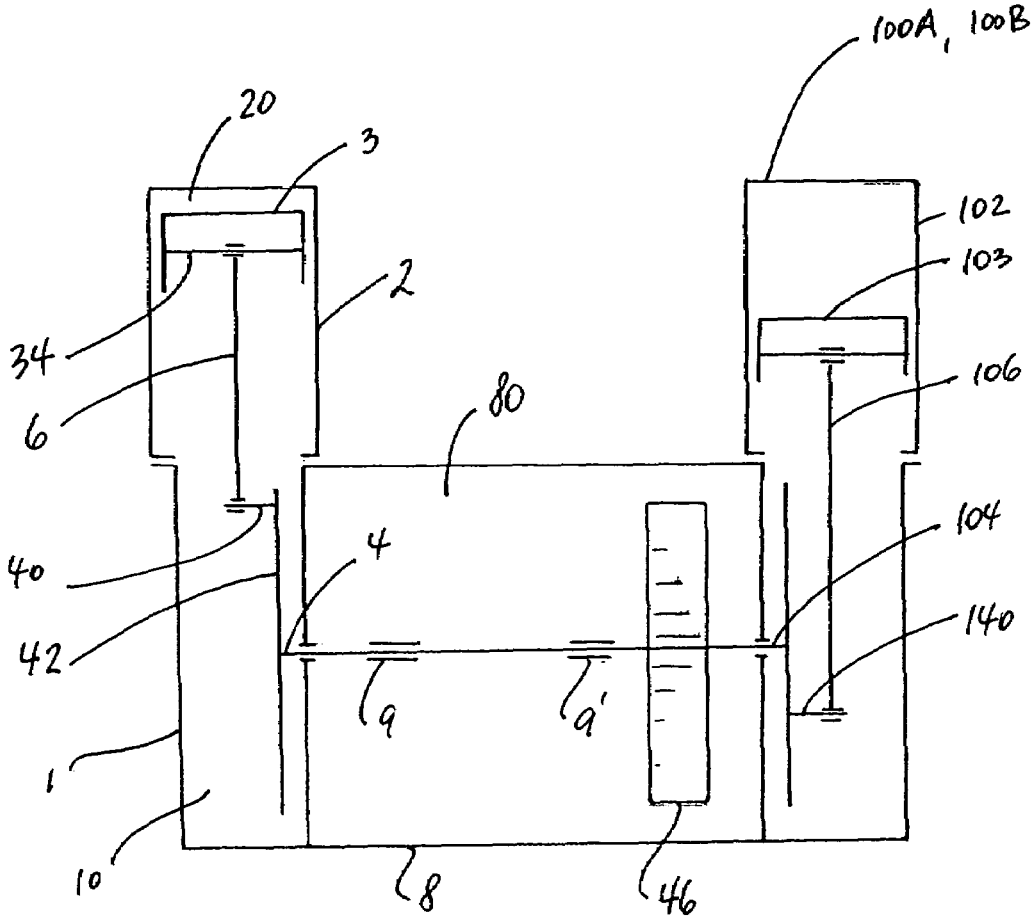
FIG. 3 is a schematic illustration of another embodiment of the present invention in which two piston-cylinder units are combined.

Referring to FIG. 3, in another embodiment of the invention, the piston engine can include a second piston 103 and a second cylinder 102 unit in which second ends 104 of the crankshafts (only one crankshaft is shown in FIG. 3) also project out of housing 8. Each of the second ends of the crankshafts (only one end is shown in FIG. 3) are provided with a crank pin 140 which is connected via associated piston rods 106 to the cylinder 102 of the second piston-cylinder unit.

As previously mentioned, the piston engine of the present invention can be a power generating piston engine, such an internal combustion piston engine, or a power consuming engine, such as a piston compressor or pump.

A piston power generator, for example an internal combustion piston engine, can be combined with a power consuming piston engine, such as a compressor or a pump, to form the above-described second piston-cylinder unit. In such a case, the first piston 3 and the associated cylinder 2 can form an internal combustion engine that generates power that is transmitted to crankshaft 4. The second piston-cylinder unit shown in FIG. 3 then comprises a piston 103 that reciprocates inside a second cylinder 102 and which may, for example, be the piston of a power consuming compressor unit 100A or the piston of a power consuming pump 100B. It is of course equally possible to use the single piston 3-cylinder 2 unit as a power consuming unit only, such as a compressor or a pump. In such a case, power for reciprocating the piston in the cylinder is supplied from a proper power source (not shown) via crankshaft 4 and piston rod 6.

The present application discloses the main features of the invention and is not limited to the embodiments described herein. To the contrary, the present invention encompasses all arrangements which make use of the present invention over and beyond the above-described embodiments herein. Thus, the arrangements including the features of the present invention can include and combine the individual features of the present invention set forth in the claims.

Reference numbers in the claims, the description and the drawings are only provided to enhance the understanding of the present invention, and they in no way limit or otherwise affect the scope of protection.

The invention claimed is:

1. A piston engine having at least one dry-running piston-cylinder unit comprising a first housing (1); at least one cylinder (2) arranged in or on the first housing (1) and a piston reciprocably movable therein; a first crankshaft (4); a second crankshaft (5); the first and second crankshafts (4, 5) being parallel and rotating synchronously in opposite directions; axes of rotation (X, X') of the crankshafts (4, 5) extending parallel to a center plane (Z) of the cylinder and being laterally offset relative thereto; first and second piston rods (6, 7) associated with piston (3) so that a first end of the first piston rod (6) is rotatably mounted relative to piston (3) and a second end thereof is rotatably mounted on a crank pin (40) of the first crankshaft (4), and wherein a first end of the second piston rod (7) is rotatably mounted on piston (3) and a second end thereof is rotatably mounted on a crank pin (50) of the second crankshaft (5); synchronization gears (46, 56) in engagement with each other and connecting the crankshafts (4, 5) with each other; and a second housing which includes a lubricant, the crankshafts (4, 5) being journalled relative to the second housing and arranged so that a first end of each crankshaft (4, 5) sealingly projects from the second housing (8) preventing lubricant from escaping from the second housing into the first housing; the crank pins (40, 50) and the respective piston rods (6, 7) connected thereto being arranged in the first housing (1) and outside the second housing (8).

2. A piston engine according to claim 1 wherein the synchronization gears (46, 56) are arranged in the second housing (8) holding the lubricant.

3. A piston engine according to claim 1, wherein the second housing (8) is integrally formed with the first housing (1).

4. A piston engine according to claim 1 including a bearing (41, 36; 51, 37) formed to prevent the escape of lubricant journalling the respective piston rods (6, 7) on the corresponding crank pins (40, 50) and the piston.

5. A piston engine according to claim 1, including at least one common bearing block (9, 9') for the crankshafts (4, 5) inside the second housing (8); wherein the bearing block (9, 9') is constructed of a material having a first coefficient of thermal expansion; wherein the synchronization gears (46, 56) are constructed of a material having a second coefficient of thermal expansion; and wherein the bearing block (9, 9') and the synchronization gears (46, 56) in a radial direction are configured and the first and second coefficients of thermal expansion are selected so that a thermal expansion of the bearing block (9, 9') between the axes of rotation (X, X') is substantially equal to a thermal expansion of the synchronization gears (46, 56).

6. A piston engine according to claim 5 wherein the crankshafts (4, 5) are constructed of a material having a third coefficient of thermal expansion, and wherein the bearing block (9, 9'), the crankshafts (4, 5) and the synchronization gears (46, 56) in their radial direction are dimensioned, and the first, second and third coefficients of thermal expansion are selected and adjusted so that the thermal expansion of the bearing block (9, 9') and the parts of the crankshafts (4, 5) extending therethrough are substantially the same as the thermal expansion of the synchronization gears (46, 56) and the part of the crankshafts surrounded by the synchronization gears (46, 56).

7. A piston engine according to claim 1 including a second piston-cylinder unit, wherein second ends of the crankshafts (4, 5) also project out of the second housing (8), and wherein each of the second ends of the crankshafts (4, 5) are provided with a crank pin which is connected via associated piston rods to a cylinder of the second piston-cylinder unit.

8. A piston engine according to claim 7 wherein one of the piston-cylinder units comprises a dry-running pump or a dry-running compressor, and wherein the other one of the piston-cylinder units comprises a combustion engine which drives the pump or compressor.

9. A piston engine according to claim 1, wherein the piston engine comprises a compressor.

10. A piston engine according to claim 1, wherein the piston engine comprises a pump.

11. A piston engine according to claim 1, wherein the piston engine comprises a combustion engine.

* * * * *